US007243668B1

(12) United States Patent
Kroeze

(10) Patent No.: US 7,243,668 B1
(45) Date of Patent: Jul. 17, 2007

(54) ADJUSTABLE CANE WITH BUILT IN PICKUP

(76) Inventor: Steven H. Kroeze, 12603 E. 206th St., Lakewood, CA (US) 90715

( * ) Notice: Subject to any disclaimer, the term of this patent is extended or adjusted under 35 U.S.C. 154(b) by 0 days.

(21) Appl. No.: 11/206,452

(22) Filed: Aug. 18, 2005

Related U.S. Application Data

(60) Provisional application No. 60/602,720, filed on Aug. 19, 2004.

(51) Int. Cl.
*A45B 9/04* (2006.01)

(52) U.S. Cl. ..... 135/77; 135/66

(58) Field of Classification Search ..... 135/65, 135/66, 75, 77, 80, 81; 294/19.1
See application file for complete search history.

(56) References Cited

U.S. PATENT DOCUMENTS 2,346,038 A * 4/1944 Mason ..... 294/19.1
2,836,188 A * 5/1958 Lee ..... 135/66
2,891,811 A * 6/1959 Strickler ..... 294/19.1
4,768,819 A * 9/1988 Tarlow et al. ..... 294/7
5,392,800 A * 2/1995 Sergi ..... 135/65
5,636,650 A 6/1997 Kroeze ..... 135/66
5,640,985 A * 6/1997 Snyder et al. ..... 135/65
6,550,490 B1 * 4/2003 Morton et al. ..... 135/66

* cited by examiner

*Primary Examiner*—David Dunn
*Assistant Examiner*—Noah Chandler Hawk
(74) *Attorney, Agent, or Firm*—Klein, O'Neill & Singh, LLP; James G. O'Neill

(57) ABSTRACT

A cane having a handle, and a trigger rotatably and slidably held in a slotted opening in an upper portion of a hollow body of the cane adjacent to the handle. The upper hollow portion of the cane is telescopically mounted in a lower hollow portion of the hollow body so as to adjust the length of the cane. The rotatable and slidable trigger is actuated so as to move a non-resilient control rod and cable to rotate a lever arm outwardly from the elongated hollow body through a slotted opening formed in the lower hollow portion, towards a support foot of the cane to pick up objects.

10 Claims, 3 Drawing Sheets

ADJUSTABLE CANE WITH BUILT IN PICKUP

CROSS REFERENCE TO RELATED APPLICATION

This application claims priority of provisional application Ser. No. 60/602,720 filed on Aug. 19, 2004.

BACKGROUND OF THE INVENTION

1. Field of the Invention

This invention relates generally to canes, and more particularly, to an adjustable cane having a pickup built into it that is easier to manufacture and assemble.

2. Description of Related Art

Canes are well known for helping a user to walk and support themselves in an erect position. However, many people who use canes are afflicted with some type of ailment or have other debilitating conditions that make it difficult or impossible for these people to bend over or stoop to pick up an object that might be on a floor or other surface. Therefore, many persons using a cane who have some type of debilitating condition have problems picking up such items as coins, keys, and the like, which might be dropped, or which might be on a lowered surface. There, therefore, is a long felt need in the art for a cane with some type of pickup means to enable a person who has problems bending or stooping to pick up small items with the cane.

One such prior art device is shown in U.S. Pat. No. 5,636,650, in the name of Steven H. Kroeze, the inventor named herein. This prior art cane is very handy and useful, but is expensive to manufacture and/or assemble, especially in today's competitive environment. There, therefore, exists a need in the art for a streamlined, easy to use and inexpensive to manufacture, adjustable cane usable by a variety of different people, and which cane has a pickup at an outer end that is more easily operated to allow such persons to grip and/or manipulate remote objects, without the need to bend or stoop.

SUMMARY OF THE INVENTION

Accordingly, it is a general object of the present invention to provide an improved combination cane and pickup. It is a particular object of the present invention to provide an improved, low cost adjustable cane having a pickup at an outer end thereof. It is a still more particular object of the present invention to provide an improved combination cane and pickup in which the cane is adjustable in length, and the pickup is held entirely within the body of the cane when not in use. It is a still more particular object of the present invention to provide an improved combination cane and pickup that helps support a user in an erect walking position, and that further provides a remote object gripping mechanism, completely held within the cane itself, to enable a user to hold and manipulate a retrievable object without having to stoop or bend. And, it is a final particular object of the present invention to provide an adjustable cane having a rotatable and slidable trigger mounted on one end thereof to operate a gripping element rotatably secured entirely within the cane, at an opposite end, and which adjustable cane is especially low in cost to manufacture.

In accordance with one aspect of the present invention there is provided an improved combination adjustable cane and pickup assembly having a rotatable and slidable trigger mounted in and extending out from a hollow upper housing and connected internally of the housing by a non-resilient, flexible control rod to operate a gripping element held within a hollow lower housing adjacent the other end thereof.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, wherein like reference numerals are used throughout the several views, and, in which:

DESCRIPTION OF THE PREFERRED EMBODIMENTS

Figure 1:
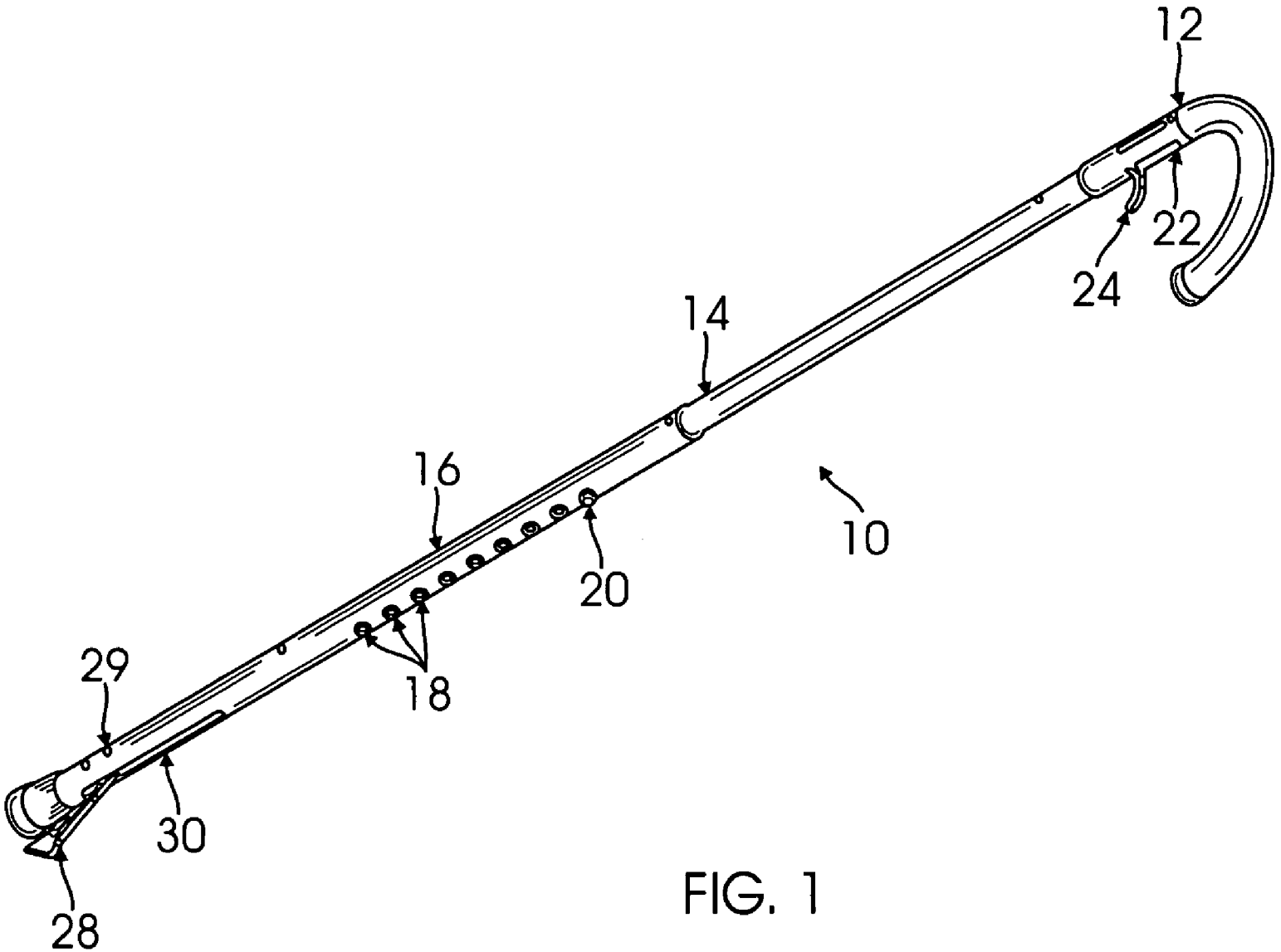
FIG. 1 is a perspective view of a combination cane and pickup of the present invention with a pickup element in a partial extended position.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe an improved, adjustable cane and gripping element assembly generally indicated at 10.

The cane assembly 10 comprises an upper handle portion 12, secured to an elongated tubular, hollow top or upper body portion 14, telescopically mounted within an elongated tubular, hollow bottom or lower body portion 16. A plurality of openings 18 are provided in the elongated hollow upper and lower portions 14, 16 whereby a button 20, biased by a spring 21, movably secured interiorly of the hollow inner portion of upper body portion 14 may be selectively pressed inwardly and the bottom and top body portions 14, 16 moved with respect to each other so that the button 20 moves and extends through further aligned openings 18. In this manner the overall length of the cane 10 may be easily adjusted.

The bottom hollow portion 16, and/or the top hollow portion 14 may also include means added or formed therein to prevent the bottom and top portions from being rotated with respect to each other and from being pulled apart. Such means could comprise extending lip portions, or the respective portions could be provided with a key and keyway system, or the like.

The upper hollow body portion 14 is preferably provided with a slotted opening 22 having a reciprocating (slidable) and rotatable trigger 24 mounted therein. The trigger 24 includes a first or upper portion or trigger grip 26 rotatably mounted within the hollow upper portion 14 about a pin 27 held in a block 23. The block 23 is slidable within the hollow upper portion 14, while the trigger 24 is first rotated in the block until it contacts an angled stop 41 and then slidable, along with the block, within the hollow upper portion 14 along the slot 22, in the direction of arrow 40, against the action of a trigger spring 38 held in the hollow upper body, between the solid and broken line positions shown in FIG. 4, to reciprocally move a flexible, non-resilient control rod 25 held in an opening formed in the trigger grip 26, so as to move cable 32 and actuate a gripping arm, element or pickup 28, as described more fully below.

Figure 5:
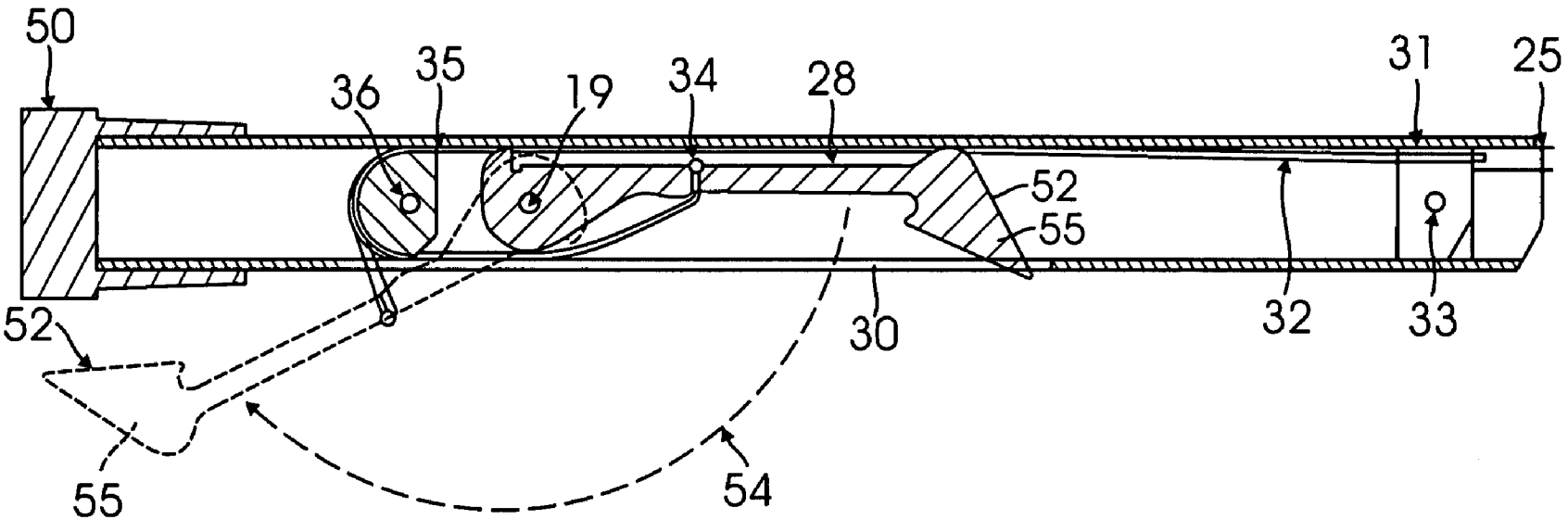
FIG. 5 is an enlarged partial cross sectional view of the lower or pickup end of the cane showing a stop block, a non-resilient line connected to a movable pickup arm and a guide for the line, before attachment to the pickup arm.

The trigger 24 is connected to the gripping arm, element or pickup 28, such as a lever or finger, rotatably mounted about the pivot pin 29, within the hollow lower body portion 16. The gripping or lever arm includes a spring normally biasing the arm into the hollow body. The lever arm 28 is rotatable in and out of the lower body portion 16 (see arrow 54 in FIG. 5), through a further slotted opening 30 formed therein so as to be completely held within the lower hollow body portion of the cane itself, when in the withdrawn or rest position. The trigger 24 and lever arm 28 are connected together by the flexible, non-resilient control rod 25, connected to a stop block 31 and a non-resilient string or cable 32, also referred to as an arm line; which cable is also connected to the arm 28 by means of a stop 34, after passing over a line guide 35, secured in the lower hollow body portion 16, by a securing pin 36.

In order to operate the cane gripping or pickup arm 28, the trigger 24 is squeezed to first rotate the trigger in the direction of arrow 39 around the pin 27 in block 23 until it contacts an angled stop 41 and the trigger grip 26 grasps the non-resilient control rod 25. The trigger 24 and block 23 then slide in the direction of arrow 40. This sliding movement of the trigger 24 and block 23 moves or slides the flexible, non-resilient control rod 25 (see arrow 43) and cable or line 32 (secured to a lower end of the control rod 25 in the stop block 31) to move or rotate the gripping arm 28, against the bias of the spring.

The stop block 31 is preferably held in place by a pin 33 and includes a narrow opening through which the cable 32 passes, but which is too small for the control rod 25 to pass through. This stop block 31 also makes it more difficult for the upper and lower portions 14, 16 of the cane to be pulled apart. The cable 32 is preferably connected as described, but could be otherwise connected to the stop block 31 and/or control rod 25. Furthermore, the stop block 31 could be allowed to move a limited distance, for example between detents or other stops or stopping means held in the lower hollow body portion 16.

Figure 4:
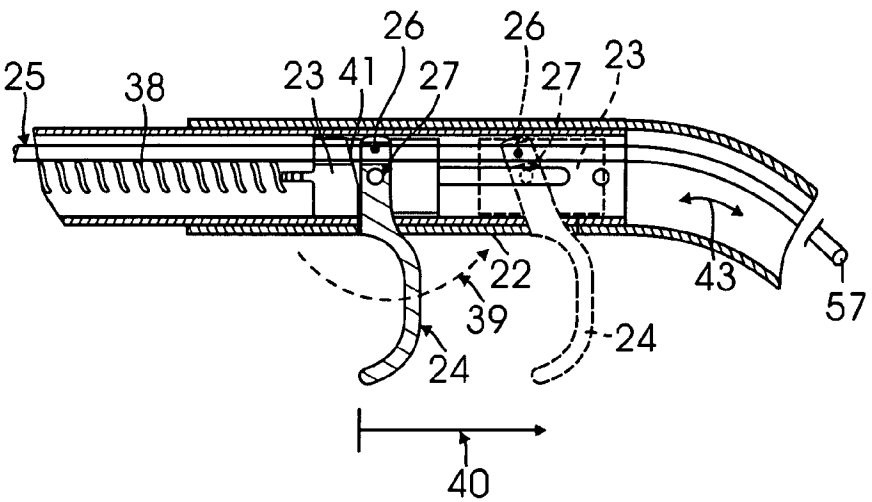
FIG. 4 is an enlarged partial cross sectional view of the upper or handle end of the cane showing the trigger and control rod.
Figure 3:
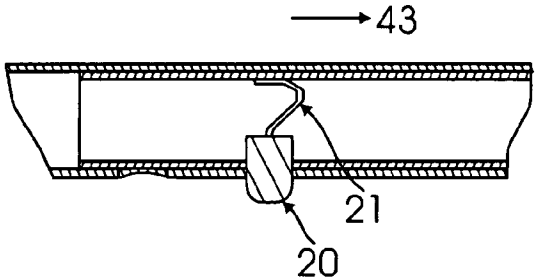
FIG. 3 is an enlarged partial cross sectional view of an adjustable lock button.

The operation of the pickup arm 28 of the cane 10 of the present invention will now be described. Upon actuation (rotation and sliding) of the trigger 24, in the direction of the arrows 39, 40, the control rod 25 will be moved upwardly from the stop block 31, through or past the spring 21 and toward the handle in the direction of arrow 43 (FIG. 4). This movement will move the cable or line 32 secured to a lower end of the control rod 25, so as to flip or rotate the lever arm or finger 28 outwardly, through slot 30, from the interior of the hollow lower portion 16, in the direction of the arrow 54, to a position where an outer soft tip 52 of a hooked end 55 of the lever arm may contact the rubber tip or foot support 50. If a small item, such as a coin, or a set of keys is lying on a surface, or other area that may be reached by the cane, the lever arm 28 will capture the item between its soft tip 52 and the foot support 50 so as to enable a user of the cane to pick up the item remote from the handle end 12 of the cane. Furthermore, the hooked end 55 of the lever arm 28, allows the cane to snag items with loops, such as shoe laces.

Figure 2:
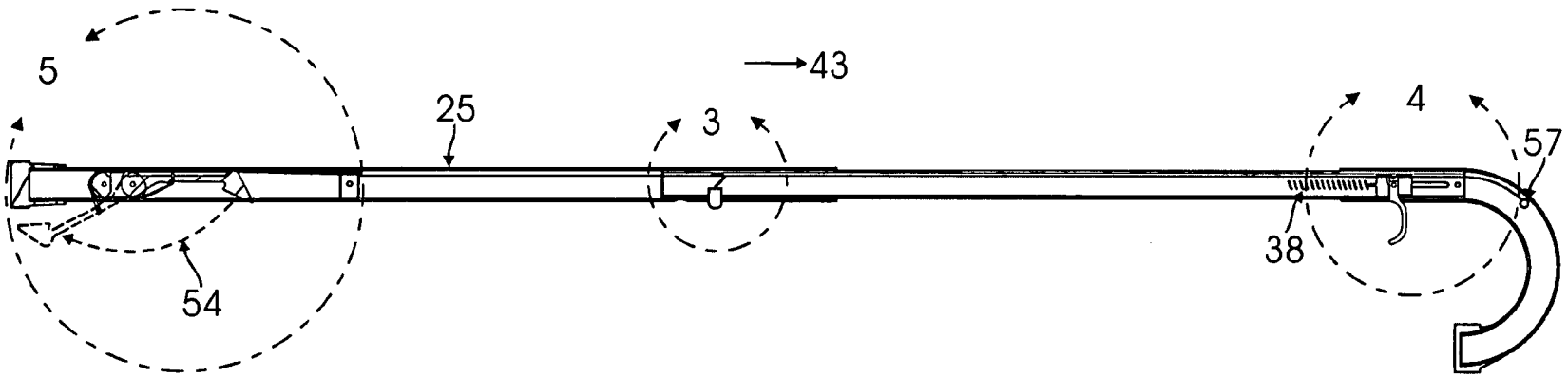
FIG. 2 is a cross sectional view of the hollow adjustable cane and pickup of FIG. 1.

Turning again to FIGS. 2 and 4, it should be noted that upon adjustment of the length of the cane, by telescoping the upper tubular body portion 14 into and out of the lower tubular body portion 16, upon actuation of the button 20 inwardly against the spring bias 21, a first end 57 of the control rod 25 will be moved in the direction of the arrow 43. After the button 20 is released, and secured within further aligned openings 18, the control rod 25 will be retained in position.

It, therefore, can be seen that the present invention provides a new and improved telescopingly adjustable cane that can be manufactured at lower cost because of fewer parts, and which also includes an internally mounted pickup means actuable by a trigger rotatable and slidably mounted in an upper portion of the cane, adjacent the handle end thereof, so as to rotatably actuate a lever arm entirely internally mounted within the lower portion of the cane, outwardly against a support foot to pick up any objects which might be captured between the support foot and lever arm.

Those skilled in the art will appreciate that the above described preferred embodiments are subject to numerous modifications and adaptations without departing from the scope and spirit of the invention. Therefore, it is to be understood that, within the scope of the appended claims the invention may be practiced other than specifically described herein.

What is claimed is:

1. An adjustable cane having a pickup element, comprising:

an elongated hollow body having a first end and a second end comprised of two telescoping tubular members;

a handle secured to the first end having a rotatable and slidable trigger mounted therein;

the second end having a resilient support foot and a lever arm rotatably held within the elongated hollow body;

a non-resilient control rod held in the elongated hollow body and connected between the rotatable and slidable trigger and a stop block in the elongated hollow body; and a non-resilient cable connected between the lever arm and the non-resilient control rod in the stop block, whereby upon rotatable and slidable movement of the trigger away from the second end the lever arm will be rotated out of the elongated hollow body toward the resilient support foot.

2. The adjustable cane having a pickup element of claim 1, further including a line guide held in the second end, and wherein the non-resilient cable passes over the line guide before it is secured to the lever arm.

3. The adjustable cane having a pickup element of claim 2 wherein the rotatable and slidable trigger is mounted in a block held in the first end and extends through a slot formed in the first end; the rotatable and slidable trigger having an inner end that is selectively secured to the non-resilient control rod whereby upon rotatable and slidable movement of the trigger the non-resilient control rod will be slid in the elongated hollow body.

4. The adjustable cane having a pickup element of claim 3 wherein the lever arm is normally held in the elongated hollow body by a spring, and rotates outwardly through a slot formed in the second end upon rotatable and slidable movement of the trigger to actuate the non-resilient control rod and non-resilient cable.

5. The adjustable cane having a pickup element of claim 4 wherein the trigger includes a first gripping portion and is rotatably mounted about a pin held within the block in the hollow first end portion; and wherein the first gripping portion selectively holds the non-resilient control rod.

6. The adjustable cane having a pickup element of claim 5 wherein the length of the cane is adjusted by telescoping the upper tubular body portion into and out of the lower tubular body portion upon depression of a button inwardly into the elongated hollow body against the bias of a spring; and wherein a first end of the control rod will be moved in the elongated hollow body.

7. An adjustable cane having a pickup element, comprising:

an elongated hollow body having a first end and a second end comprised of two telescoping tubular members;

a handle secured to the first end and a movable trigger slidably and rotatable mounted in the first end adjacent a handle portion;

the second end having a resilient support foot and a lever arm rotatably held within the elongated hollow body;

a non-resilient control rod held in the elongated hollow body and connected between the movable trigger and a stop block in the elongated hollow body;

the movable trigger being mounted in a block held in the first end and extending through a slot formed in the first end; the movable trigger having an inner end that is selectively secured to the non-resilient control rod whereby upon rotation and sliding of the movable trigger the non-resilient control rod will be slid in the elongated hollow body; and a non-resilient cable connected between the lever arm and the non-resilient control rod in the stop block, and a line guide held in the second end with the non-resilient cable passing over and guided by the line guide before it is secured to the lever arm, whereby upon movement of the movable trigger away from the handle portion and the second end the lever arm will be rotated out of the elongated hollow body toward the resilient support foot.

8. The adjustable cane having a pickup element of claim 7 wherein the lever arm is normally held in the elongated hollow body by a spring, and rotates outwardly through a slot formed in the second end upon rotatable and slidable movement of the movable trigger to actuate the non-resilient control rod and non-resilient cable.

9. The adjustable cane having a pickup element of claim 8 wherein the length of the cane is adjusted by telescoping the upper tubular body portion into and out of the lower tubular body portion upon depression of a button inwardly into the elongated hollow body against the bias of a spring; and wherein a first end of the control rod will be moved in the elongated hollow body.

10. An adjustable cane having a pickup element, comprising:

an elongated hollow body having a first end and a second end comprised of two telescoping tubular members;

a button held between the of two telescoping tubular members and movable inwardly into the elongated hollow body against the bias of a spring;

a handle secured to the first end and a movable trigger slidably and rotatable mounted in the first end adjacent a handle portion;

a non-resilient control rod held in the elongated hollow body and connected between the movable trigger and a stop block held in the second end;

the movable trigger being mounted in a block held in the first end and extending through a slot formed in the first end; the movable trigger having an inner end that is selectively secured to the non-resilient control rod whereby upon rotation and sliding of the movable trigger the non-resilient control rod will be slid in the elongated hollow body;

a non-resilient cable connected between the lever arm and the non-resilient control rod in the stop block, and a line guide held in the second end with the non-resilient cable passing over and guided by the line guide before it is secured to the lever arm; and the second end having a resilient support foot and the lever arm being held completely within the second end; the lever arm being normally held in the elongated hollow body by a spring, and being rotated outwardly through a slot formed in the second end upon movement of the movable trigger to actuate the non-resilient control rod and non-resilient cable; and the length of the cane being adjusted by telescoping the upper tubular body portion into and out of the lower tubular body portion upon depression of the button and moving the button between a plurality of aligned openings formed in the two telescoping tubular members.

* * * * *